United States Patent [19]

Lam

[11] Patent Number: 4,872,574

[45] Date of Patent: Oct. 10, 1989

[54] CONTAINER

[76] Inventor: David C. S. Lam, 23 Hong San Walk, Singapore, Singapore, 2368

[21] Appl. No.: 121,717

[22] Filed: Nov. 17, 1987

[51] Int. Cl.[4] ..... B65D 7/00

[52] U.S. Cl. ..... 220/1.5; 220/19

[58] Field of Search ..... 220/1.5, 4 F, 19, 83

[56] References Cited

U.S. PATENT DOCUMENTS

| | | | |
|---|---|---|---|
| 1,722,416 | 7/1929 | Glenny | 220/19 |
| 1,909,098 | 5/1933 | Davis | 220/19 |
| 2,175,390 | 10/1939 | Harrison | 206/506 |
| 2,765,099 | 10/1956 | Lively | 206/506 |
| 2,964,217 | 12/1960 | Mickler, Jr. | 206/506 |
| 3,532,246 | 10/1970 | Wenta | 220/19 |
| 3,575,311 | 4/1971 | Etienne | 217/42 |
| 3,659,743 | 5/1972 | Box | 220/97 E |
| 3,759,416 | 1/1973 | Constantine | 220/97 F |
| 3,901,410 | 9/1976 | Schurch | 220/1.5 X |
| 4,042,111 | 1/1977 | Smith | 206/508 |
| 4,139,098 | 1/1979 | Mollon | 206/507 |
| 4,416,374 | 11/1983 | Smith et al. | 206/507 |
| 4,478,344 | 10/1984 | Rehrig | 220/83 |
| 4,613,045 | 9/1986 | Watson | 206/512 |

FOREIGN PATENT DOCUMENTS

| | | |
|---|---|---|
| 0920626 | 3/1963 | United Kingdom . |
| 1184212 | 3/1970 | United Kingdom . |
| 1234277 | 6/1971 | United Kingdom . |
| 1439064 | 6/1976 | United Kingdom . |
| 1032412 | 8/1986 | United Kingdom . |
| 1032413 | 8/1986 | United Kingdom . |
| 2180820 | 4/1987 | United Kingdom . |

*Primary Examiner*—Steven M. Pollard

*Attorney, Agent, or Firm*—Saidman, Sterne, Kessler & Goldstein

[57] ABSTRACT

A container for packaging rubber sheets or blocks for sea transport is formed by a framework of generally L-shaped cross-section members comprising uprights and base members with a tubular rail joining the ends of the uprights. Gussets may be provided for strengthening the long sides of the container. The sides of the framework of the container 1 may be filled by a mesh structure of interlinked chains or bars. The container has a base which may be corrugated for strength or may be non-corrugated and may be provided with channels or gripps for receiving the forks of a forklift truck. Rectangular cross-section extension members may be provided at the corners of the base for additional stability.

12 Claims, 10 Drawing Sheets

CONTAINER

BACKGROUND OF THE INVENTION

The present invention relates to containers for transporting goods. In particular the invention relates to containers for packaging rubber sheets or blocks for sea transport. The traditional method of transporting such sheets or blocks is to pack them in wooden crates which are destroyed at the destination port. There is therefore a need for a robust, reusable container which, when empty, can be shipped back to the departure port at minimum cost.

SUMMARY OF THE INVENTION

A first aspect of the invention provides a container having the shape of a rectangular or square frusto-pyramid, whereby empty containers can be stacked one inside another.

Another aspect of the invention provides a container comprising an open sided framework in which the sides are traversed by a mesh which may be formed by interlinked chains.

The embodiments of the invention may be further provided with a container having a base which is corrugated, thus providing enhanced strength. Slots or channels for receiving the forks of a forklift truck are preferably provided in the base for four way entry.

The container may be formed from sheet metal sections which are shaped by stamping and then fixed together by welding or riveting etc. The container may be manufactured from metal, for example, aluminium or steel.

Preferably the container is of plastics material for lightness and durability. Extruded plastics sections may be used for the framework with a moulded base. The sections may be joined by gluing or welding etc. Alternatively the container may be integrally moulded.

The mesh structure filling the container sides may be moulded of plastics or of metal chains linked to the container framework. Alternatively, the mesh may be constructed from bars connected to the container framework. In this case, the structure may comprise one or more flat bars (i.e. bars of rectangular cross-section) orientated substantially horizontally and supported by one or more substantially vertically orientated flat bars.

Very preferably the base of the container is provided with retractable members which may extend laterally from the container base to stabilise the container and also to support a container on top of another container when stacking filled containers.

Each retractable member may be provided with a downward flange at the end facing away from the body of the container. The downward flanges serve to prevent excessive lateral movement of stacked containers, and so prevent the collapse of a stack of containers.

BRIEF DESCRIPTION OF THE DRAWINGS

The invention will be further described by way of example with reference to the accompanying drawings, in which.

DETAILED DESCRIPTION OF THE INVENTION

Figure 1:
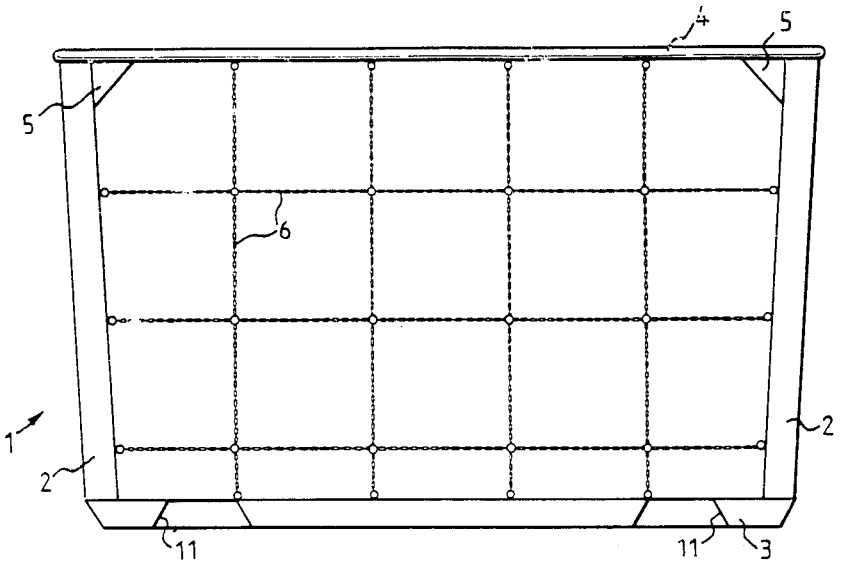
FIG. 1 is a side view of a first embodiment of the invention.

FIG. 1 shows a side view of a container 1 according to the invention. The container is formed by a framework of generally L-cross-section members comprising uprights 2 and base members 3 with a tubular rail 4 joining the upper ends of the uprights 2. Gussets 5 strengthen the long sides of the container 1. The container sides are open and are filled by a mesh of interlinked chains 6 attached to the vertical and horizontal members.

Figure 2:
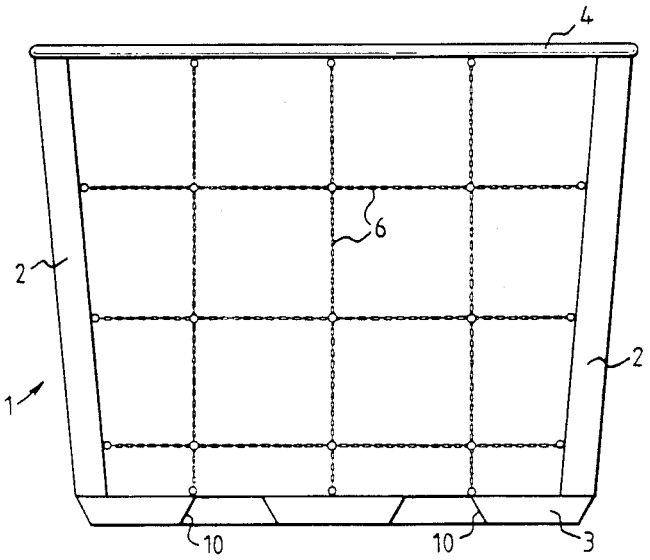
FIG. 2 is an end view of the embodiment of FIG. 1.

As seen in FIGS. 1 and 2 the shape of the container is frusto-pyramidal, that is tapering towards the base so that one container will sit inside another.

Figure 3:
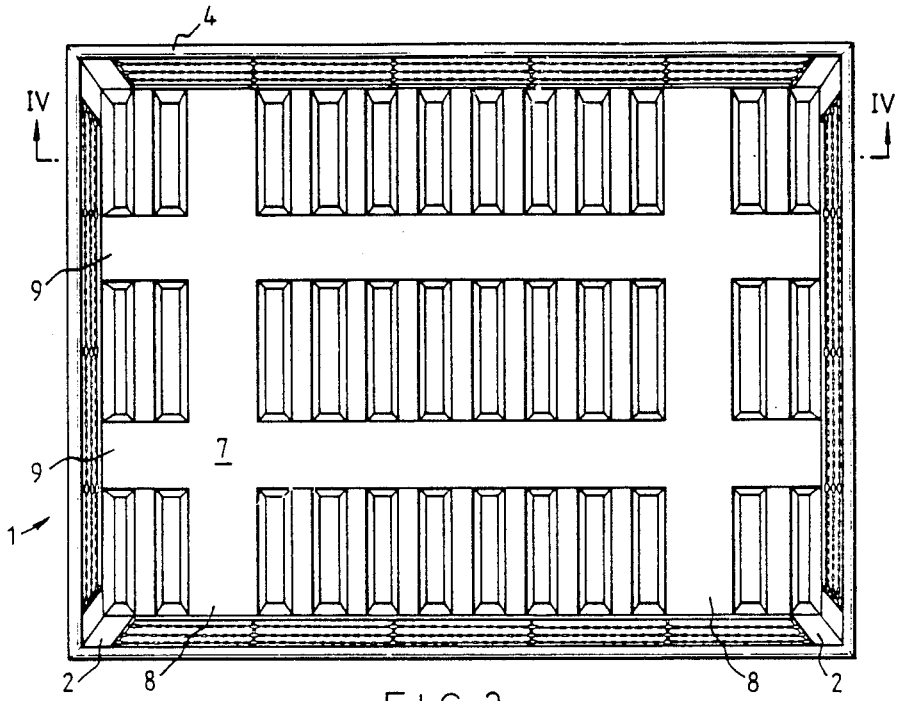
FIG. 3 is a plan view of the embodiment of FIG. 1.
Figure 4:
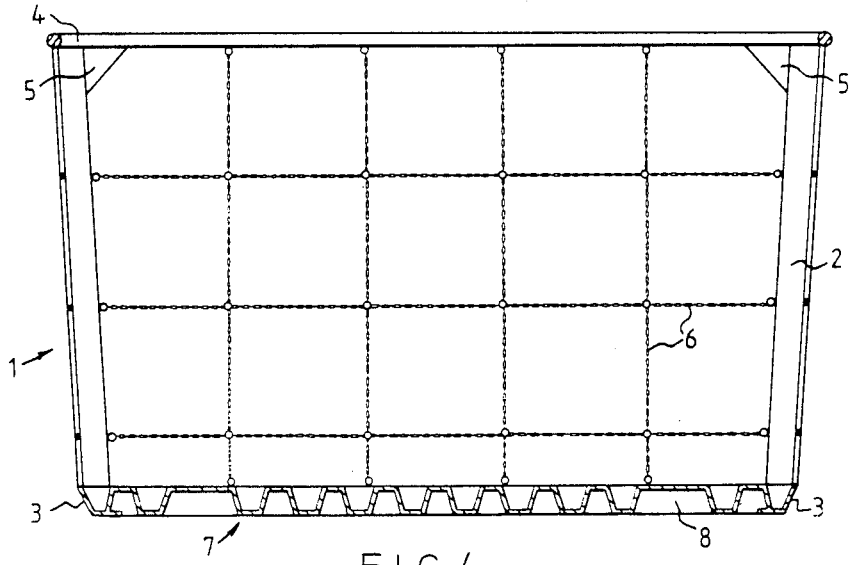
FIG. 4 is a cross-section along the line IV—IV of FIG. 3.
Figure 5:
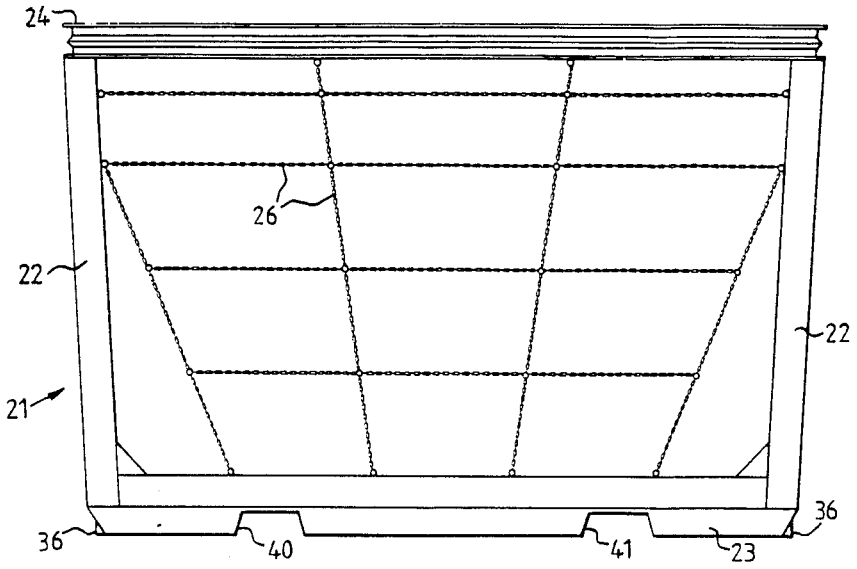
FIG. 5 is a side view of a second embodiment of the invention.
Figure 6:
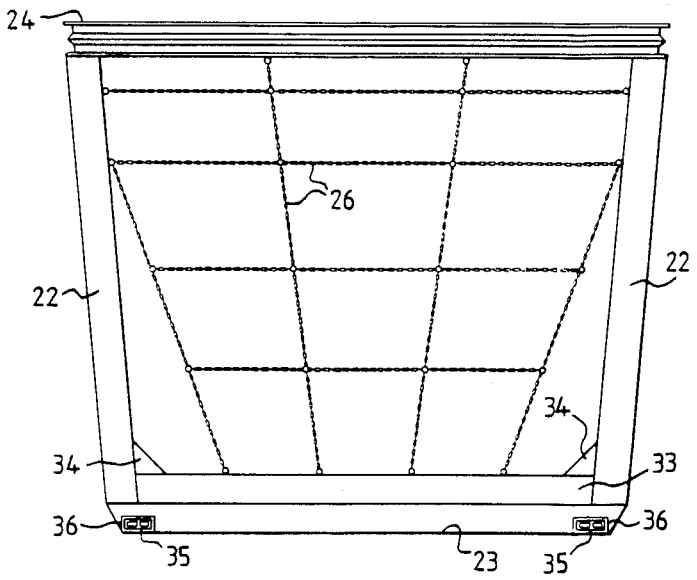
FIG. 6 is an end view of the embodiment of FIG. 5.
Figure 7:
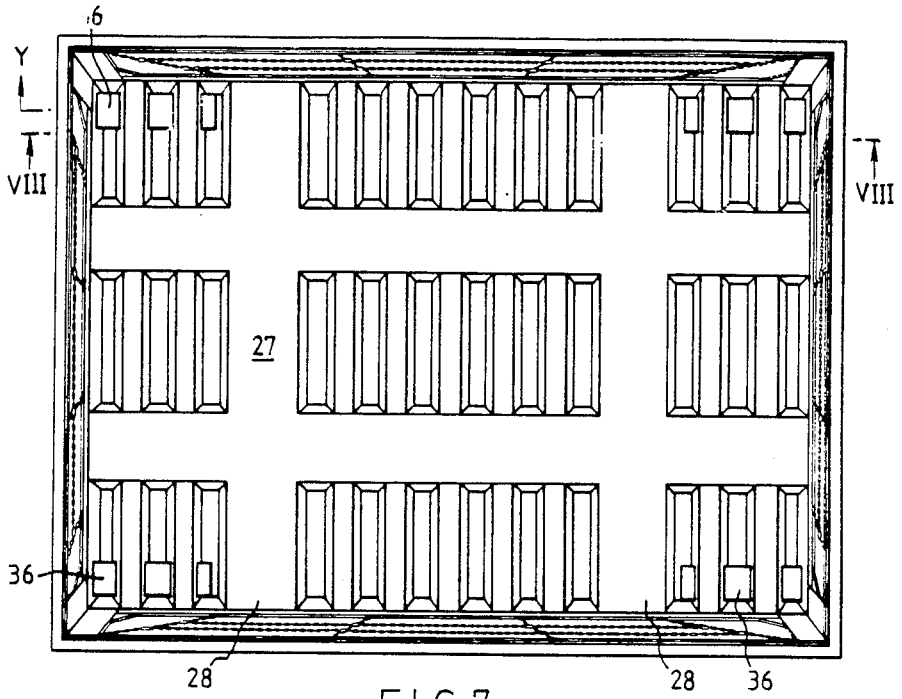
FIG. 7 is a plan view of the embodiment of FIG. 6.
Figure 8:
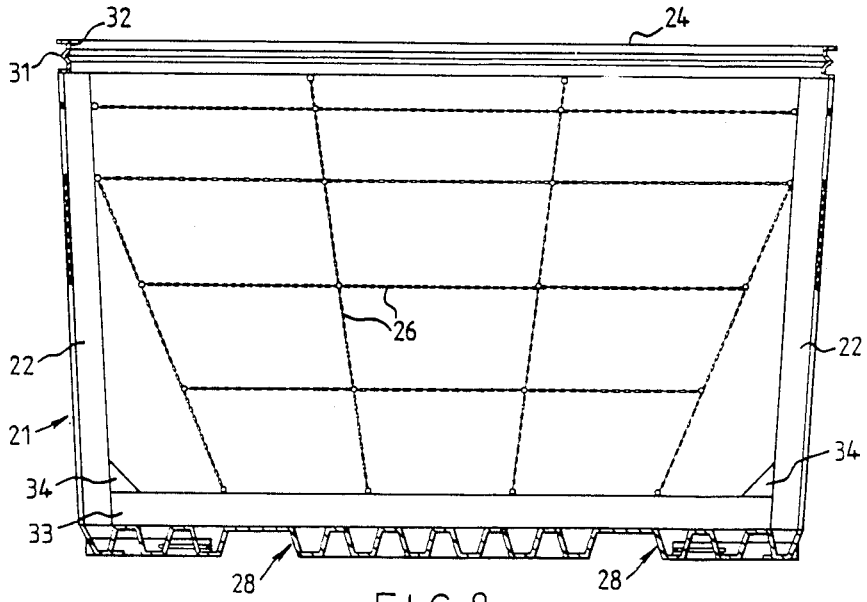
FIG. 8 is a cross-section along the line VIII—VIII of FIG. 7.
Figure 9A:
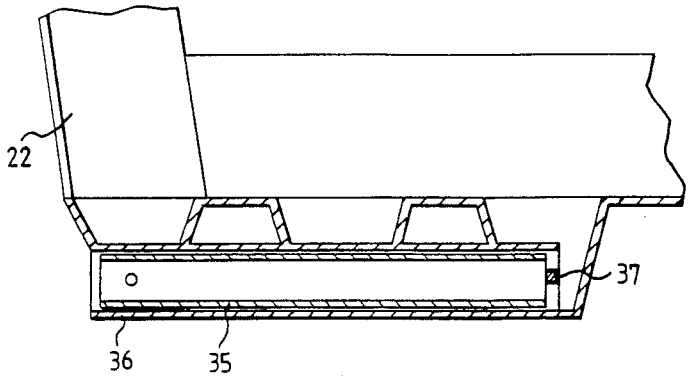
FIGS. 9*a* and 9*b* are cross-sections at the base of the container of FIG. 5 in the region of arrow Y.
Figure 9B:
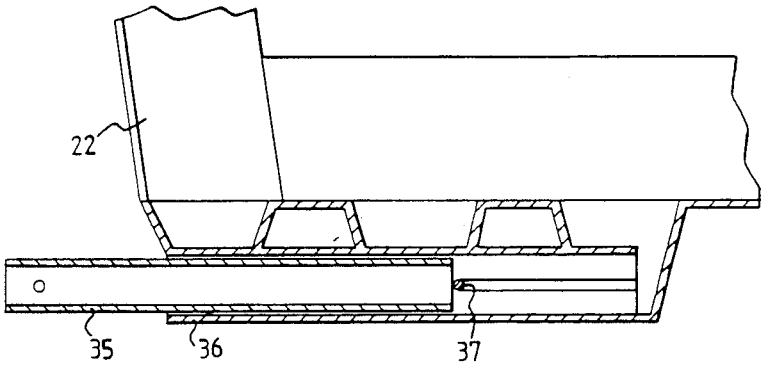

The base 7 of the container is corrugated (FIGS. 3 and 4) for strength, a corrugated plate sitting on and being attached to the L-shaped base members 3 as seen in FIG. 4. The corrugations of the base provide inverted channels 8, 9 for receiving the forks of a forklift truck, corresponding apertures 10, 11 being provided in the base members 3.

The container is preferably constructed of plastics material.

FIGS. 5 to 9 show a second embodiment of the invention which is constructed in a similar manner to the embodiment of FIGS. 1 to 4. L-shaped cross-section upright members 22 are joined at their upper ends by a channel section rim 24 (see FIG. 8) having an indent 31 in its central web portion 32. 'L' shaped cross-section base members 23 join the lower ends of the uprights 22 and a guard plate 33 extends a short way up the container sides from the base members 23. Gussets 34 strengthen the join between the guard plates 33 and uprights 22. A chain like mesh 26 fills the sides of the container 21.

The base 27 is corrugated and provided with channels 28 for receiving the forks of a forklift truck, with corresponding recesses 40, 41 being provided in the base members 23.

Rectangular cross-section extension members 35 are housed in slots 36 at the four corners of the base and arranged to be slid outwardly (FIG. 9*b*) to provide additional stability for the container and to support the container on top of a like container. The members 35 each have a bar 37 at their inner end, which slides in apertures 38 in the walls of slots 36 to limit the sliding movement of the members 35.

FIGS. 10 to 14 shows a third embodiment of the invention which is constructed in a similar manner to the second embodiment described above. 'L'-shaped cross-section upright members 50 are joined at their upper ends by a channel section rim 52 which is similar to the rim 24 described with reference to FIG. 8. The upright members 50 are joined at their lower ends by 'L' shaped cross-section base members 54 and a guard plate 56 extrudes a short way up the container sides from the base members 54.

The container has a base 58 which is non-corrugated. The base 58 is provided with a pair of gripping members 60 for receiving the forks of a forklift truck. The gripping members 60 are formed with sloping sides. The gripping members 60 may be welded onto the base as separate strips, the members 60 being formed and shaped separately from the base in this case. Alternatively, the gripping members 60 may be formed integrally with the base by, for example, a stamping process.

Gussets 5 are formed between the uprights 50, the guard plate 56 and the rim 52 in order to strengthen the container.

Figure 15A:
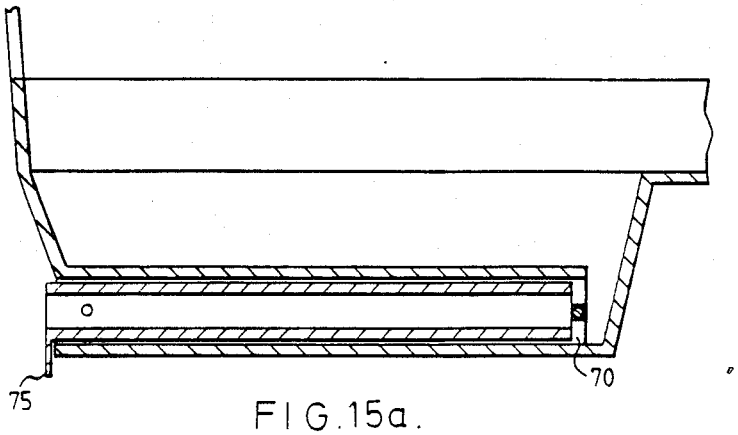
FIGS. 15*a* and 15*b* are fragmentary sectional views of a retractable member at the base of the container of FIG. 10.
Figure 15B:
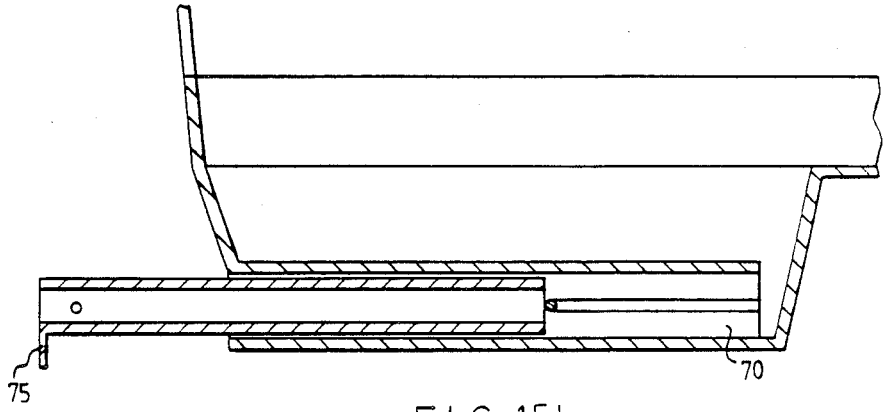

Rectangular cross-section extension members 68 are housed in slots 70 (FIG. 15*a*) at the four corners of the base and arranged to be slid outwardly (FIG. 15*b*) to provide additional stability for the container. The construction and functions of the extensions members 68 and slots 70 are similar to the extension members described with reference to FIG. 9*a* and 9*b* except that one end of each of the extrusion members have a downwardly projecting flange 75. The flanges serve to prevent collapse of stacked containers by preventing excessive relative displacement in a lateral direction.

The sides of the container are filled with a mesh structure 72 which is formed from four horizontal bars supported, in the major sides of the container by two rows of four flat-bars which are angled with respect to the vertical. The flat bars may be welded or glued at their points of intersection 74, and ends of the flat bars which contact the upright members 50 and the guard plates 56 may be glued or welded thereto so as to fix the mesh structure to the container.

Figure 10:
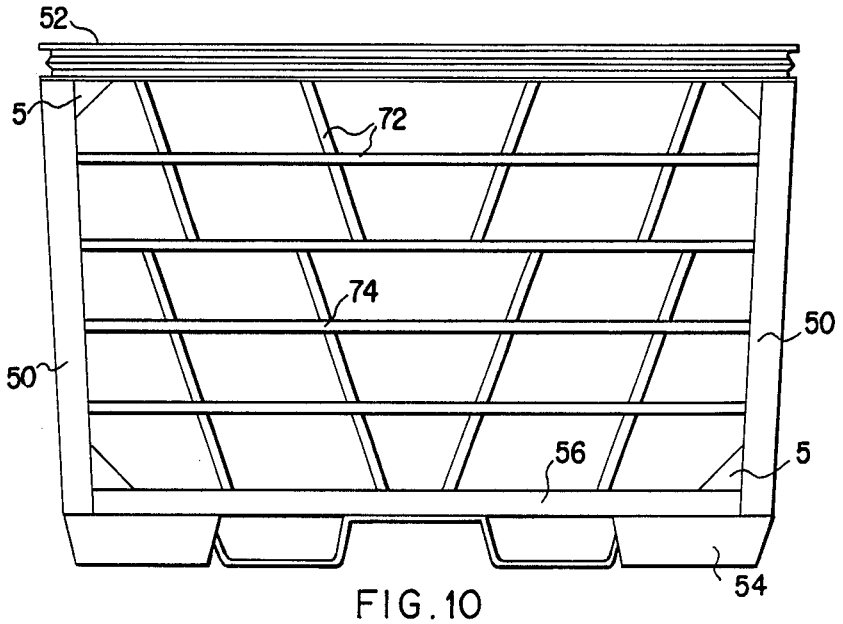
FIG. 10 is a side view of a third embodiment of the invention.
Figure 11:
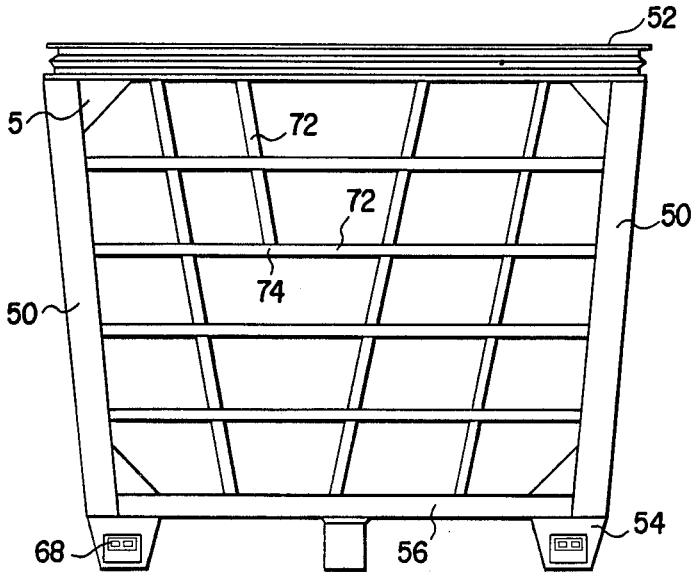
FIG. 11 is an end view of the embodiment of FIG. 10.
Figure 12:
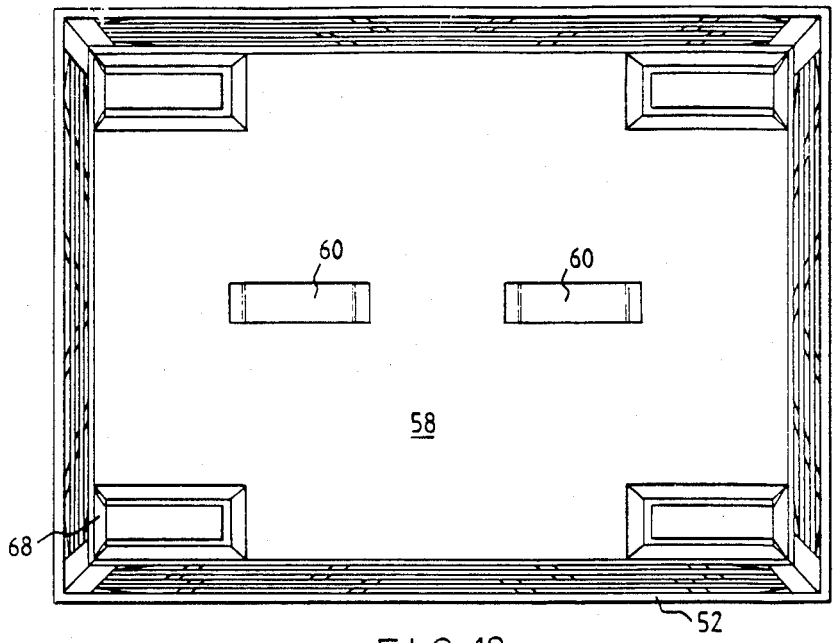
FIG. 12 is a plan view of the embodiment of FIG. 10.
Figure 13:
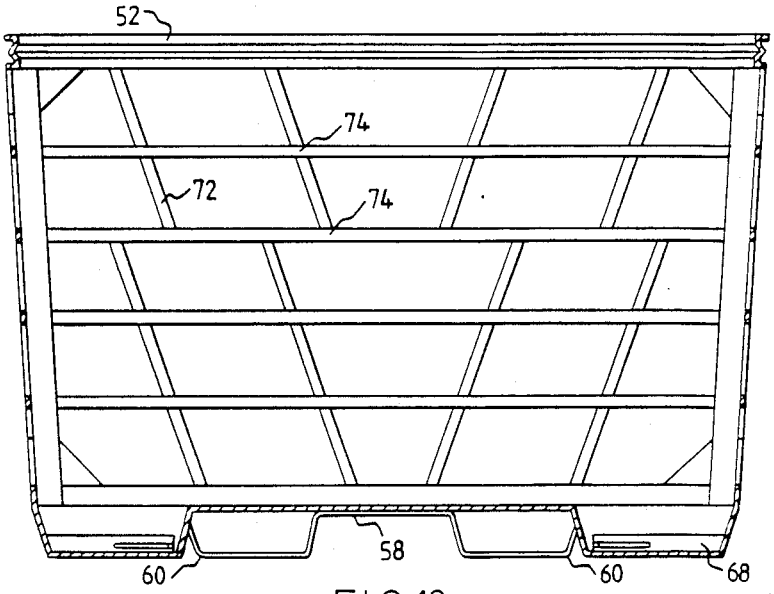
FIG. 13 is a cross-section along the line X—X of FIG. 12.
Figure 14:
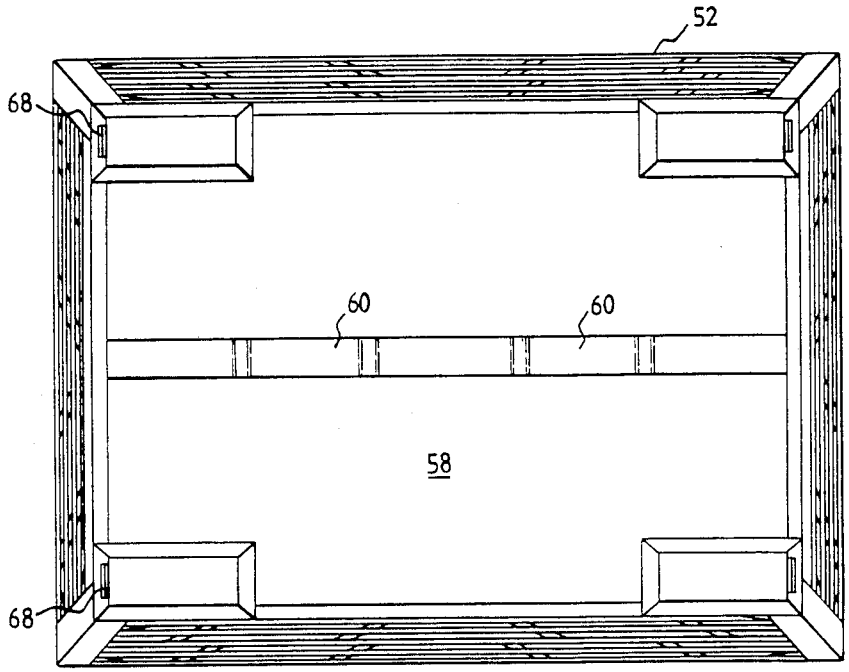
FIG. 14 is an underside view of the embodiment of FIG. 10.

The mesh of horizontal and vertically angled bars 72 is illustrated in FIGS. 10 and 11. The vertically angled bars 72 in the sides of the container do not all extend across the entire height of the container. In the major sides of the containers, there are two rows of vertically angled bars, while in the minor side or end of the container, three of the four angled bars extend from the rim 52 to the guard plate 56.

Figure 16:
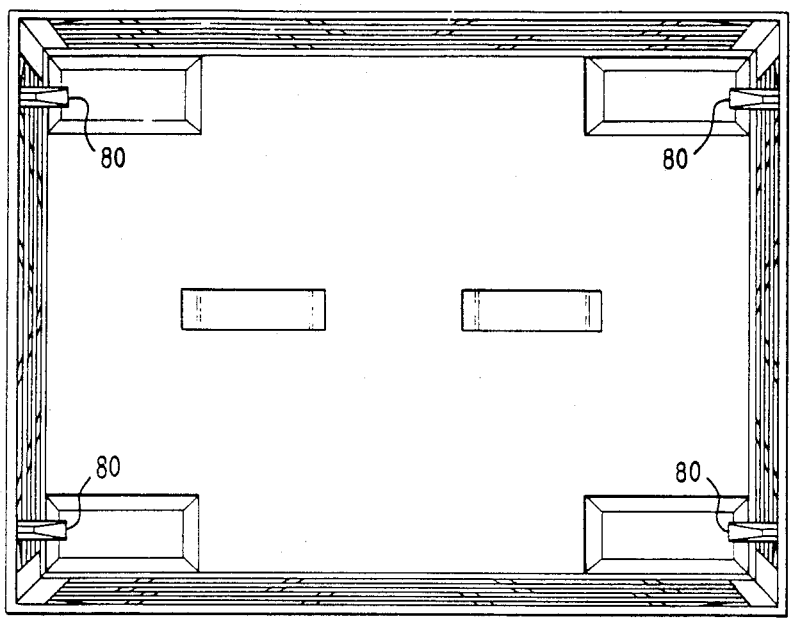
FIGS. 16, 17 illustrate a modified version of the third embodiment shown in FIG. 12.

As an alternative to using the rectangular extension members 68, support protrusions 80 may be fused onto the rim 52 in four locations. FIG. 16 illustrates a plan view of the embodiment of FIGS. 10 to 14 which has been modified by eliminating the extrusion members 68 and replacing them with the support protrusions 80. The support protrusions 80 serve to enable stacking of the containers, the protrusions supporting the base of the support container.

The advantage of the protrusions 80 is that there is no need to pull out the retractable extension members at the four corners. This saves labour and cost. In addition, the containers are lighter and can, therefore, carry more cargo.

Figure 17:
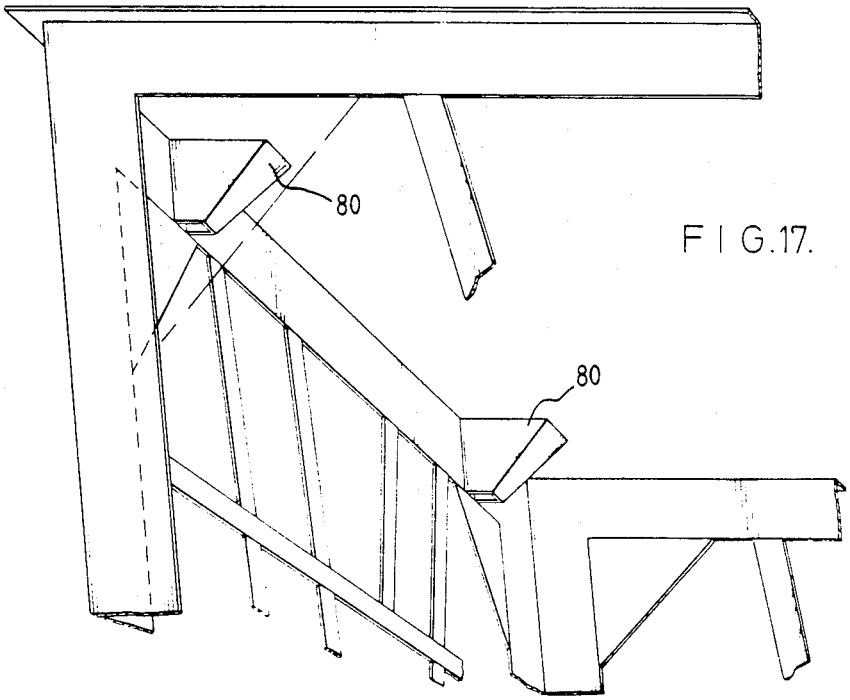

FIG. 17 is a fragmentary perspective view of the support protrusions 80.

I claim:

1. A container having a square or rectangular frusto-pyramid shape and a base, whereby empty containers can be stacked one inside another, wherein said container comprises uprights at each corner thereof, a rim connecting the upper ends of said uprights, a base linked to the lower ends of said uprights, open sides which are traversed by a mesh, gussets positioned between said uprights, said base, and/or said rim for strengthening said container, and means in said base for receiving forks of a forklift truck.

2. A container according to claim 1 wherein the base is non-corrugated, and said means in said base comprises gripping members formed on said base.

3. A container according to claim 2, wherein said gripping members are welded to said base.

4. A container according to claim 1, wherein the base is corrugated, said means in said base being formed by channels of said corrugated base.

5. A container according to claim 1, wherein the mesh is formed by interlinked chains.

6. A container according to claim 1, wherein said mesh is constructed from horizontally and angled vertically arranged bars, said horizontally arranged bars being connected to said uprights, and said angularly vertically arranged being connected to said rim and/or said base.

7. A container according to claim 6, wherein said angularly vertical bars are arranged in two rows, one row being connected between said rim and one of said horizontally arranged bars, and the other being connected to said one horizontally arranged bar and said base.

8. A container according to claim 1, formed from sheet metal sections which are shaped by stamping and then fixed together by welding or riveting.

9. A container according to claim 1, wherein extruded plastics sections are used for the framework and a moulded base section is used for the base.

10. A container according to claim 1, wherein said base, is provided with retractable members which can extend laterally from said base for stabilising said container and for supporting filled containers one on top of another when stacked.

11. A container according to claim 10, wherein downwardly extending flanges are provided at an end of each retractable member which is external of said container, said downwardly extending flanges being provided for restraining lateral movement of said containers when stacked.

12. A container according to claim 1, wherein support protrusions are positioned on the rim of the container for supporting the base of another container stacked on top of the container.

* * * * *